United States Patent [19]

Muller

[11] 4,150,705

[45] Apr. 24, 1979

[54] METHOD AND APPARATUS FOR MANUAL PREPARATION WORK ON FOUNDRY MOLDING BOXES AT A SINGLE-STATION THROUGHFLOW MOLDING MACHINE

[75] Inventor: Günter Müller, Karlsruhe, Fed. Rep. of Germany

[73] Assignee: Badische Maschinenfabrik G.m.b.H., Fed. Rep. of Germany

[21] Appl. No.: 736,579

[22] Filed: Oct. 28, 1976

[30] Foreign Application Priority Data

Oct. 30, 1975 [DE] Fed. Rep. of Germany ..... 2548577

[51] Int. Cl.[2] ..... B22C 25/00

[52] U.S. Cl. ..... 164/18; 164/323

[58] Field of Search ..... 164/15, 18, 191, 180, 164/210, 212, 225, 182, 323; 198/339, 472

[56] References Cited

U.S. PATENT DOCUMENTS

| | | | |
|---|---|---|---|
| 2,134,117 | 10/1938 | Floyd et al. | 164/18 |
| 3,273,207 | 9/1966 | Taccone | 164/18 X |
| 3,743,004 | 7/1973 | Becke | 164/18 |

FOREIGN PATENT DOCUMENTS

| | | | |
|---|---|---|---|
| 1227107 | 2/1960 | France | 164/210 |
| 4724336 | 12/1967 | Japan | 164/210 |

*Primary Examiner*—Richard B. Lazarus

*Assistant Examiner*—K. Y. Lin

*Attorney, Agent, or Firm*—Craig & Antonelli

[57] ABSTRACT

When an empty molding box arrives at the molding machine on a roller track extending through the machine, it is placed on a pattern plate carrier with a pattern situated thereon and is lowered thereon on to a transverse roller track on which it is transferred, by means of a thrust drive operating on the carrier, to the empty station of a two-station transporting carriage on which it is then moved, by means of another thrust drive operating on the carriage, to one of the two outer working stations of a three-station roller track, namely a preparation track, parallel to the first-mentioned roller track, where the preparation work is done. As the two-station carriage moves thus, an already prepared molding box and carrier on its other station arrives at the central station of the preparation track and is then drawn back to the molding machine. After the molding operation the pattern plate carrier is extracted for re-use with another empty molding box, while the completed molding box is transferred away along the first-mentioned roller track. Coupling means, comprising plates on the first-mentioned thrust drive and the pattern plate carriers, move into and out of engagement as required when the carrier is moved vertically in the molding machine or horizontally on the preparation track.

14 Claims, 5 Drawing Figures

Fig. 1
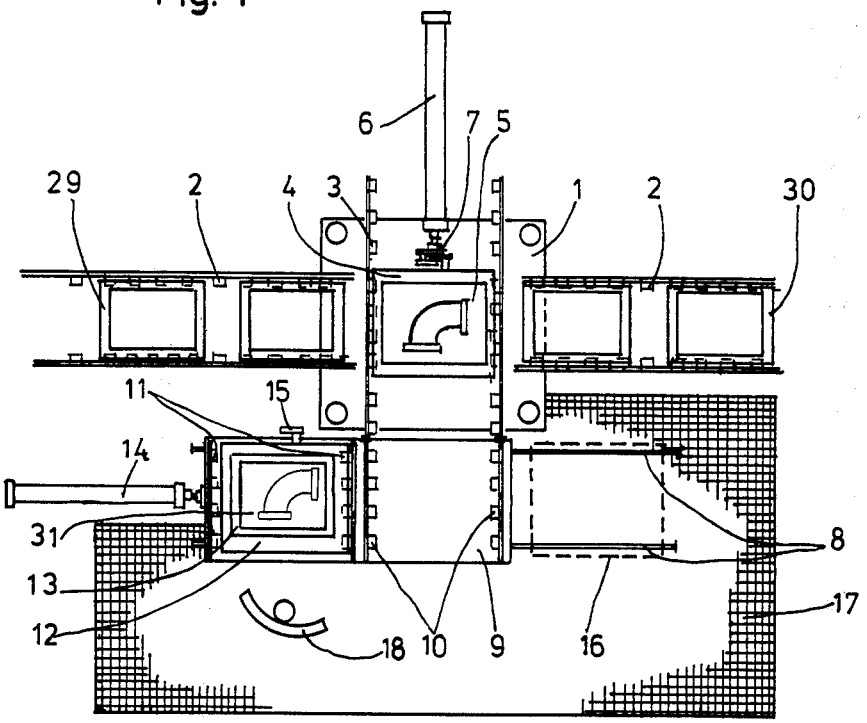
Fig.4
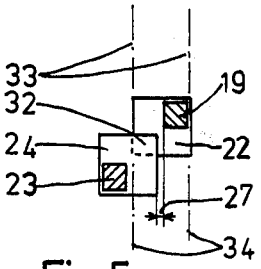
Fig. 2
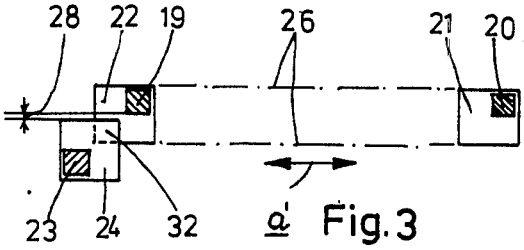
Fig. 3
Fig. 5
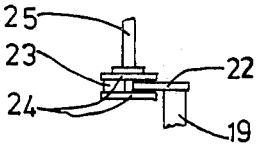
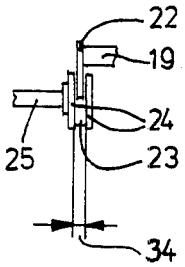

METHOD AND APPARATUS FOR MANUAL PREPARATION WORK ON FOUNDRY MOLDING BOXES AT A SINGLE-STATION THROUGHFLOW MOLDING MACHINE

The invention relates to a method of carrying out manual preparation work at a single-station throughflow molding machine with linear transport of the molding boxes through the molding machine and alternate molding of at least two pattern plates. The invention also relates to an apparatus for carrying out the method.

Single-station throughflow molding machines are known wherein molding is carried out on two pattern plates alternately. These may be pattern plates for a lower box and upper box of the same casting, or two upper boxes or two lower boxes of two different castings. In such machines, the two pattern plates, which are each situated on a pattern plate carrier, are placed on a carriage which is adapted to travel transversely to the throughflow direction and which moves to and fro. In such cases, it is also known to bring devices laterally over the moved-out pattern plate in order to clean sand residues away from the pattern plate and, for example, to spray with a parting or separating substance before the next molding operation begins. These devices can operate automatically at the rhythm of the throughflow molding machine; but these operations can be carried out only as long as no box is mounted on the pattern plate.

Frequently, however, preparation work is required which can only be carried out when the box is mounted and also can only be carried out by hand; moreover, such work also requires the provision of components and materials such as, for example, the application of special molding sands, the placing of chills and exothermal risers, or the molding in of cores. Such preparation work is not possible at the machine described hereinbefore, since the necessary space in the immediate vicinity of the machine is lacking. If, nevertheless, it were intended to carry out such preparation work at a throughflow molding machine, there would be the serious disadvantage that it would be necessary to work with two persons, since it is not possible for one person to change his working side because of the through travel of the molding boxes.

An object of the invention is to provide a method and an apparatus for carrying out the method by means of which it is possible to carry out preparation work with only one person, such person being able to work in a position which is safe against accidents and provides favorable working conditions, and such that the person in question does not disturb the automatic molding operation, or not to any important extent.

According to one aspect of the present invention, in a method of the kind initially defined above, after the placing of a box on one pattern plate the latter is transferred together with the box on to the central station of a three-station preparation track which is situated adjacent to the molding machine and parallel to the direction of transport, and the said plate is then displaced on to one of the two outer stations of the said track for the purpose of carrying out the preparation work and at the same time the molding box prepared on the other outer station is shifted, with the other pattern plate, on to the central station and then transferred to the molding machine for molding, to be transferred again to the free central station of the preparation track after extraction of the pattern plate and mounting of another molding box on the said plate.

The two outer stations of the parallel track are used for carrying out the preparation work. The operator who carries out this work has his working position situated at some distance from the machine and is thus not in any danger from the machine. He can reach the molding boxes from the same side. The automatic molding operation is not disturbed, or only to the minimum extent absolutely necessary. The person concerned has to take only a very few steps to change from one outer station of the preparation track, past the central station to the other outer station.

For carrying out the method, the invention provides an apparatus having a single-station throughflow molding machine, at least two pattern plate carriers and a roller track which extends linearly through the molding machine, in which apparatus a preparation track is provided adjacent to the molding machine and parallel to the roller track, the preparation track having three stations each corresponding approximately to the molding box size, the central of these three stations being situated directly adjacent to the molding machine and the two outer stations being for use as work stations for the preparation work, and a transverse track is provided between the molding machine and the central station. A two-station transporting carriage is preferably adapted to move forwards and backwards to the extent of one station on the preparation track.

Thus, while one box is situated on one of the outer stations of the parallel preparation track for carrying out preparation work, the other box can be filled with sand in the molding machine and compacted. After the compacting of the sand and the extraction of the pattern plate, the box moves out of the molding machine along the linear roller track whilst the pattern plate with its carrier, after mounting of an under-box, is transferred to the transporting carriage and displaced on to the empty outer station. Transport to and fro requires only a single transporting carriage whose two stations alternately form the central station for transfer of the box with the pattern plate carrier from the molding machine to the preparation track, and one of the two outer stations for carrying out the preparation work.

Transferring the metal plate carriers on to the transporting carriage, and moving the carriage on the preparation track, can be carried out with conventional driving means; a releasable coupling, for example a magnetically operated clutch or the like, may be provided between the pattern plate carrier and the drive for the carrier. Preferably, however, a coupling is provided which comprises, on the said drive, a coupling part comprising two plates which are arranged at a parallel spacing and at right-angles to the direction of movement of the drive and also, on the pattern plate carrier, a coupling part comprising a plate which engages with some clearance between the two plates on the said drive, the plates of these coupling parts partly overlapping one another at least in the thrust direction whilst they fit into one another in the two directions at right-angles thereto.

With these features, the invention makes use of the relative movements which occur between the drive and the pattern plate carrier for effecting the coupling and uncoupling. When, in a known manner, lifting movement of the pattern plate carrier in the molding machine occurs, coupling is established between the carrier and the drive, in that the plate which is provided on the pattern plate carrier enters between the two plates on the drive until they overlap. In the region of overlap the necessary shape-locking connection for displacement is then established in both directions. When the pattern plate carrier arrives on the transporting carriage of the preparation track and the said carriage is moved transversely to the previous direction of movement, the pattern plate carrier is released; at the same time, the other pattern plate carrier, which has been prepared, moves with the carriage and its coupling plate engages between the two plates provided on the drive, so that it can be drawn back to the molding machine. In the lowering movement or lifting movement which takes place in the machine, the plates disengage again. Thus it is not necessary to provide separate driving or control means for the coupling.

The invention will now be described, by way of example, with reference to the accompanying drawings, in which:

FIG. 1 shows a diagrammatic plan view of a single-station throughflow molding machine with preparation track;

FIG. 2 shows a diagram of a coupling operation on the preparation track, in side view;

FIG. 3 shows a side view turned through 90° relatively to FIG. 2;

FIG. 4 shows a diagram of a coupling operation in the molding machine and

FIG. 5 shows a plan view turned through 90° relatively to FIG. 4.

FIG. 1 shows a single-station through flow molding machine 1 with a roller track 2 which extends linearly through the said machine and which transports empty molding boxes 29 to the molding machine and transports molded molding boxes 30 away from the said machine. A corresponding section of this roller track, which is not shown as it is cut away in in the drawing, is situated in the molding machine. Arranged below this upper roller track section, in the molding machine, is a portion of a further roller track 3 which, however, extends transversely, and on which a pattern plate carrier 4 with a pattern plate 5 situated thereon and a molding box which has been mounted, can be moved transversely out of the machine. The drive 6 for the transverse transport is a thrust drive constructed as a pressure cylinder which is connected releasably to the pattern plate carrier 4 by means of a coupling 7.

Situated parallel and adjacent to the roller track 2 is a three-station preparation track in the form of a rail track 8 on which a carriage 9 can travel. The carriage 9 is driven by a pressure cylinder 14 and has two roller track sections 10 and 11, which are respectively in alignment with the stationary roller track 3 in the two end positions of the carriage 9. In the example shown, the roller track section 11 is occupied by a pattern plate carrier 12 with pattern plate 31 and molding box 13. A coupling part 15 can be seen on the pattern plate carrier 12. Adjacent to the rail track 8 is a working stand 17 for the operator 18 and also for frames and containers for the material which is being continually used by the operator 18 for the preparation work he is carrying out.

FIG. 1 shows the moment at which the operator 18 is carrying out preparation work on the molding box 13 and the pattern plate 31 at the left-hand outer station of the three-station preparation track 8. At the same time a molding box is placed on the pattern plate carrier 4 which is situated in the molding machine 1 and the two are lowered on to the transverse roller track 3, the coupling 7 being thereby closed as will be explained with reference to FIGS. 4 and 5. By means of the pressure cylinder 6, the pattern plate carrier 4 and the molding box (not shown here) are transferred, by displacement on the roller track 3, on to the carriage 9 at the central station of the track 8.

The preparation work on the other pattern plate carrier 31, having been completed, the carriage 9 is moved by means of the pressure cylinder 14 into its other end position so that the pattern plate carrier 4, which has still to be prepared and which is standing on the roller track section 10, arrives at the right-hand outer working station 16 whilst the completely prepared pattern plate carrier 31 at the same time moves on to the central station; this results in the coupling part 15, provided on the said carrier, coming into engagement with the part of the coupling 7 on the pressure cylinder 6 as will be explained with reference to FIGS. 2 and 3.

By reversing the pressure cylinder 6, the pattern plate 31 is moved with the molding box 13 into the molding machine 1. The coupling 7 disengages, as will be explained with reference to FIGS. 4 and 5, after lifting in the molding machine. After filling with sand and compacting of the sand, the completed molding box issues from the molding machine on the roller conveyor 2. The next working cycle in the molding machine is the same as has been described herein-before, the carriage 9 being then moved from right to left on the preparation track 8.

FIGS. 2 to 5 show a coupling between the pattern plate carrier 4 or 12 and the pressure cylinder 6 or rather its piston. One part of the coupling comprises two parallel plates 24 which are provided on the piston rod 25 of the pressure cylinder 6 with parallel spacing from one another and at right-angles to the said piston rod. These coupling plates 24 are connected eccentrically to one another by a connecting element 23 with a spacing 34. The other part of the coupling comprises a plate 22 which is connected securely by way of a connecting element 19 to the pattern plate carrier 4 or 12. The spacing 34 is larger than the thickness of the plate 22. In the coupled state the plates 22 and 24 overlap with a surface area 32 so that the driving force acting at right-angles to the surface of the plates and emanating from the pressure cylinder 6 can be transmitted. On displacement of the carriage 9 on the preparation track 8 in the direction of the arrow a, the plate 22 disengages from the plate 24, and the molding element 19 can move past the plate 24 owing to the clearance 28. At the same time, when the carriage 9 moves, the plate 21 with the holding element 20 of the other pattern plate carrier moves towards the plate 24 along the path of movement 26 until the coupling parts overlap one another, so that the other pattern plate carrier is then coupled to the piston rod 25.

FIG. 4 and FIG. 5 show the method of operation of the coupling when vertical movement of the pattern plate carrier occurs in the molding machine. The initial position is the same as is shown at the left in FIG. 2. In the molding machine the completed pattern plate carrier with its coupling 19, 22 is lowered vertically downwards on to the shaking table and is also lifted upwards during pressing, while the pressure cylinder 6 with its coupling part 23, 24 remains stationary. The downward movement of the coupling parts 19, 22 is indicated by the lines 34, the connecting element 19 being able to move past the coupling plate 24 with the clearance 27.

On lifting, as shown by the lines 33, the coupling also disengages, but it re-engages when the pattern plate carrier is lowered to the level of the roller track 3, at which an area of overlap 32 is again established.

I claim:

1. A method of carrying out manual preparation work on foundry molding boxes at a single-station throughflow molding machine with linear transport of the molding boxes through the molding machine and alternate molding on at least two pattern plates, comprising the steps of: placing a box on one pattern plate; transferring the said plate together with the box on to the central station of a three-station preparation track extending adjacent to the molding machine parallel to the direction of the said transport; displacing the said plate on to one of the two outer stations of the said track for preparation work and at the same time shifting on to the central station the other pattern plate carrying a molding box prepared on the other outer station; transferring the other pattern plate and molding box to the molding machine for a molding operation in the said machine; extracting the latter pattern plate and mounting another molding box thereon; and transferring the latter pattern plate and molding box to the free central station of the preparation track.

2. Apparatus for carrying out preparation work on foundry molding boxes, comprising:

(a) a single-station throughflow molding machine;

(b) first and second pattern plates together with first and second molding boxes, respectively;

(c) a three-station preparation track means for performing work on mold cores, said preparation track means having a first side station, a second side station, and a central station separate and spaced from the single-station throughflow molding machine;

(d) transverse track means for transferring the first pattern plate together with the first molding box onto the central station;

(e) first thrust drive means for displacing the first pattern plate from the central station to the first side station for preparation work and for simultaneously shifting the second pattern plate together with the second molding box prepared on the second side station onto the central station;

(f) second thrust drive means for transferring the second pattern plate together with the second molding box from the central station to the molding machine for an operation;

(g) a two-station transporting carriage means for transferring the first pattern plate together with the first molding box from the first side station to the central station; and (h) roller track means for extracting and transferring the second pattern plate together with the second molding box from the molding machine, said roller track means being positioned transverse to the transverse track means and directly accessible to the central station of the preparation track means.

3. Apparatus according to claim 2, wherein the two-station transporting carriage means is adapted to be moved to and fro to the extent of one station on the preparation track means.

4. Apparatus according to claim 3, wherein the transporting carriage means comprises two track sections which prolong the transverse track means.

5. Apparatus according to claim 4, wherein the transverse track means and the said track sections which prolong it are roller tracks with rollers.

6. Apparatus according to claim 2, wherein the preparation track means is constructed as a rail track.

7. Apparatus according to claim 2, wherein the second thrust drive means is provided for transport of carriers for the pattern plates with the molding boxes on the transverse track means.

8. Apparatus according to claim 3, wherein the first thrust drive means is provided for moving the transporting carriage means on the preparation track means.

9. Apparatus according to claim 7, wherein the second thrust drive means is constructed as a pressure cylinder.

10. Apparatus according to claim 8, wherein the first thrust drive means is constructed as a pressure cylinder.

11. Apparatus according to claim 9, wherein, between the second thrust drive means and the carriers for the pattern plates with the molding boxes, there is provided means for coupling effectively the second thrust drive means and the carriers in the pushing or pulling direction but ineffectively in the two directions at right-angles thereto.

12. Apparatus for carrying out manual preparation work on foundry molding boxes at a single-station throughflow molding machine with at least two pattern plate carriers and a roller track which is taken linearly through the molding machine, which apparatus comprises: a molding machine, a preparation track for performing work on mold cores, said preparation track being positioned adjacent to the molding machine and parallel to the roller track said preparation track having three stations which each correspond approximately to the molding box size and of which the central station is situated directly adjacent to the molding machine and the two outer stations are for use as working stations for the preparation work; and a transverse track provided between the molding machine and the central station of the preparation track; wherein a thrust drive is constructed as a pressure cylinder and is provided for transport of the pattern plate carriers and molding boxes on the transverse track; wherein between the thrust drive and the pattern plate carrier there is provided a coupling which is effective in the pushing or pulling direction but is ineffective in the two directions at right-angles thereto; wherein the coupling consists of two cooperating parts provided respectively on the thrust drive and the pattern plate carrier, one of the said parts comprising two spaced parallel plates disposed at right-angles to the direction of thrust, and the other of the said parts comprising a plate disposed to engage between the two plates of the first part with some clearance and at least partly overlap them during pushing or pulling operations, the two parts being capable of passing one another in the two directions at right-angles to the pushing and pulling directions.

13. A method for carrying out manual preparation work on foundry molding boxes at a single-station throughflow molding machine, comprising the steps of:

(a) transferring a first pattern plate together with a molding box onto the central station of a three-station preparation track;

(b) displacing said first pattern plate onto the first side station of said three-station track for preparation work;

(c) shifting onto the central station a second pattern plate together with a second molding box prepared on the second side station of said three-station track;

(d) transferring said second pattern plate and molding box to the molding machine for an operation; and (e) extracting and transferring said first pattern plate and molding box to said free central station of said three-station track.

14. Apparatus according to claim 2, wherein the roller track means is positioned parallel to the preparation track means.

* * * * *